United States Patent [19]

Green

[11] 4,078,906

[45] Mar. 14, 1978

[54] METHOD FOR MAKING AN ABRADING TOOL WITH DISCONTINUOUS DIAMOND ABRADING SURFACES

[75] Inventor: Thomas R. Green, Elgin, Ill.

[73] Assignee: Elgin Diamond Products Co., Inc., Elgin, Ill.

[21] Appl. No.: 727,958

[22] Filed: Sep. 29, 1976

[51] Int. Cl.[2] ..... B24D 3/06; B24D 3/10

[52] U.S. Cl. ..... 51/295; 51/309 R

[58] Field of Search ..... 51/295, 309

[56] References Cited

U.S. PATENT DOCUMENTS

| | | | |
|---|---|---|---|
| 2,015,658 | 10/1935 | Bezzenberger | 51/295 |
| 2,906,612 | 9/1959 | Anthony et al. | 51/309 |
| 3,199,254 | 8/1965 | Barron | 51/295 |
| 3,751,237 | 8/1973 | Albers et al. | 51/309 |
| 3,795,497 | 3/1974 | Weiss | 51/309 |
| 3,860,400 | 1/1975 | Prowse et al. | 51/295 |
| 3,918,217 | 11/1975 | Oliver | 51/295 |

*Primary Examiner*—Donald J. Arnold

*Attorney, Agent, or Firm*—Dominik, Knechtel, Godula & Demeur

[57] ABSTRACT

A diamond abrading disc having a discontinuous pattern, and a method for making such a disc, distributing a layer of diamond particles over an abrading surface in a disc body having interspersed conductive metal zones and resist zones, and initially bonding the diamond particles to the metal zone by electrodeposition of nickel while the disc body is in horizontal position in an electrochemical bath. The diamond particles at the resist zones are then dislodged by tilting and shaking the disc body, and then repositioning the body vertically in the bath so that the initially bonded diamond particles at the metal zones may be finally bonded with further electrodeposition of nickel. The resist zones may be provided by applying resist material on a metal surface of a disc through a pattern of openings in a screen. Alternatively, conductive metal zones may be formed on a body of non-conductive material, which otherwise are resist zones.

5 Claims, 13 Drawing Figures

METHOD FOR MAKING AN ABRADING TOOL WITH DISCONTINUOUS DIAMOND ABRADING SURFACES

FIELD OF THE INVENTION

This invention relates to diamond abrading tools, particularly discs in which the abrading surface has a discontinuous diamond pattern to economize on diamond material while improving abrading action. In particular, the invention relates to improved abrading disc and an improved method for making such abrading disc whereby nonselective deposit of diamond particles on an abrading disc body are selectively bonded by electrodeposition of nickle to obtain an abrading surface having a discontinuous diamond pattern.

BACKGROUND AND PRIOR ART KNOWN AND VIEWED AS RELEVANT

Diamond particles have long been recognized as an excellent abrading material, and such diamonds have been distributed throughout resin and metal matrices, as well as being bonded to surfaces, metal and others. This art has early recognized that diamond particles can be bonded to metal bodies or surfaces by electrodepositing nickel in an electrochemical bath. The electrodeposition of nickel to bond diamond particles on the entire abrading surface of a bowl type disc is shown, for example, in U.S. Pat. No. 2,360,798. The foregoing U.S. Pat. No. 2,360,798 teaches the nonselective bonding of diamond particles to the entire metal abrading surface of a disc held horizontally in an electrochemical bath with subsequent dislodgment of diamond particles on a holding member and final bonding by vertical placement of the disc in the electrochemical bath. Other approaches have been made in the art for nonselectively holding diamond particles on a disc body, such as using a petroleum jelly base to hold the diamond particles and then heat pressing the particles into the metal support, such a procedure shown in U.S. Pat. No. 2,427,565. Similar nonselective embedding of diamond particles and later bonding by electrodeposition is shown in U.S. Pat. No. 3,517,464.

Another approach is shown in U.S. Pat No. 3,762,895 wherein fillers are used to initially hold the diamond particles in nonselective manner on an abrading surface, and then such fillers are subsequently removed by a washing step so that the individual diamond particles can be locked by electrodeposition of nickel. The use of a fabric material to lock diamond particles and hold them in position during subsequent electrodeposition has been described in U.S. Pat. No. 2,424,140.

Another attempt to nonselectively mask a side of a disc to resist electrodeposition of nickel is shown in U.S. Pat. No. 2,571,772 where grease or metal oxide film is used on one side of a disc to prevent nickel bonding. The other side of the disc is physically prevented from receiving nickel deposition so that only the rim surface has the diamond particles bonded thereto.

The present invention is concerned with providing interspersed free resist and metal conductive zones on an abrading surface of a body, and one embodiment for obtaining such interspersed zones is to utilize a screen having openings through which resist liquids are applied to the metal abrading surface. U.S. Pat. No. 2,424,140 and U.S. Pat. No. 3,571,772 teach the use of fabric materials or sieves to hold particles of diamonds in position for subsequent locking by electrodeposition.

The silk screen approach for abrading tools has been shown in U.S. Pat. no. 3,631,638 wherein a mixture of binder and diamond particles is laid down through a silk screen on a support, and then such binder is later cured. This teaching is not at all concerned with interspersing conductive and resist zones for selective locking of diamond particles on the abrading surface by electrodeposition.

OBJECTS AND ADVANTAGES OF THE INVENTION

One object of the present invention is to provide improved diamond abrading tools and method whereby a discontinuous diamond pattern is formed on an abrading surface by selectively locking diamond particles to predetermined conductive metal zones and not to resist zones interspersed among the conductive metal zones. An advantage realized in attaining this object is an economy of valuable diamond particles and increased cutting action by provision of a discontinuous pattern. The nickel bonded diamond zones are closely bunched together to provide the desired abrading properties, but there is an overall economy in diamond material since less than the entire abrading surface is covered with diamond particles. Another advantage arises from the resist zones serving as coolant wells or channels during abrading use.

Another object of the invention is improved diamond abrading tools, such as discs, and the method for making such a disc which utilizes the economies, efficiency and speed of the silk screen process to apply predetermined patterns of resist materials to a metal surface so that diamond particles may be nonselectively sprinkled over the entire abrading surface, but which diamond particles are only selectively bonded to the interspersed conductive metal zones where no resist material has been laid down.

Yet another object of the invention is to provide an improved diamond abrading disc and method for making such a disc, of the type described, in which the screen technique is used to advantage to lay down resist zones on metal surfaces of metal bodies of various dimensions, and metal surface layers bonded to backing bodies so that abrading tools of differing properties can be designed. A feature of this object is the utilization of circuit board techniques to obtain discontinuous diamond patterns for abrading tools.

Still yet another object of the present invention is to provide an improved diamond abrading disc and method for making such a disc in which a thin and flexible metal body disc has a discontinuous diamond pattern, of the type described, and which disc is provided with an elastomeric and rigid backing material to provide an improved abrading tool for lapidary type processing.

Still another object of the present invention is to provide an improved abrading disc and the method for making such a disc in which a substantially rigid circuit board type of disc body with bonded metal layer has interspersed resist and diamond particle zones on said layer, and such disc body with or without a rigid backing provides an improved abrading tool for use in lapidary type processing.

DESCRIPTION OF THE VIEWS OF THE DRAWINGS

The foregoing objects and advantages are realized together with other objects and advantages which will occur to practitioners upon considering the following disclosure of the invention including drawings wherein.

SUMMARY OF THE INVENTION

Figure 1:
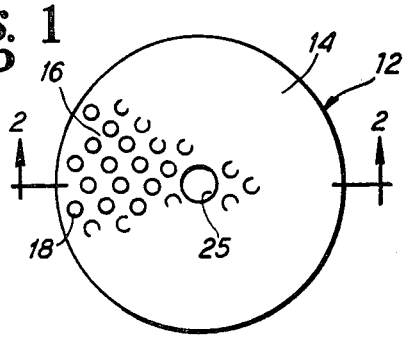
FIG. 1 is a highly diagrammatic side elevational view of an abrading disc illustrating, only in portion, nickel bonded diamond zones interspersed among discreet resist zones.

A diamond abrading disc is provided in which the abrading surface has interspersed conductive metal and resist zones which are laid down in a predetermined pattern. When the abrading disc has a metal body or surface, the resist zones are applied through a screen which is commonly referred to as a "silk screen". The resist material may be an acid resist ink which it brushed, or otherwise applied across the screen so it passes through the plurality of pattern openings in the screen onto the abrading surface. The screen is removed and the disc is then preferably deposited in a tank so an initial layer of plating is formed on the surface to "brighten" the abrading surface. Diamond particles are then sprinkled or distributed in a nonselective manner over the entire abrading surface, preferably while the discs remain in the tank, covering both the conductive metal and resist zones. The disc body is moved in level or horizontal orientation to ground surface to prevent spillage of the distributed diamond particles, and such movement is executed into an electrochemical bath wherein the disc body or its container is connected as a cathode. An anode of nickel is provided in the usual way, and such bath is conventionally prepared, such as the standard Watts bath.

The practitioner attends to the usual controls of pH and temperature, as well as attending to desired salt concentrations of the bath. Amperage is controlled according to the usual practice so that nickel may be electrodeposited around the cathode or abrading disc to initially bond the diamond particles resting on the conductive metal zones, but not bonding diamond particles resting on the resist zones. The abrading disc is maintained in horizontal orientation within the electrochemical bath so that the substantially uniform layer of diamond particles is not disturbed prior to initial bonding. Thereafter, the orientation of the disc body is changed by tilting and shaking to dislodge the diamond particles not initially bonded. The disc body with the initially nickel bonded diamond particle zones is then repositioned in vertical orientation in the bath to successively and finally bond the diamond particles to the metal abrading surface by nickel electrodeposition.

The discontinuous diamond pattern on a selected abrading surface preferably covers a minor portion of the total abrading surface, from about 20% to about up to 50%. The amount of diamond will depend on the design of the abrading tool, but the discontinuous diamond pattern is used to advantage when a substantial portion of the abrading surface is made up to the free resist zones. Diamond particles may be used in a wide variety of sizes for laying down the discontinuous pattern, say, from 80 to 800 grit size, although this may vary.

The metal surface may be the abrading surface of a solid metal disc of various thicknesses and diamters, or it may be a metal layer bonded to an isoelectric body such as composition board. This form is the familiar circuit board type wherein a light sensitive metal layer, usually copper, is adhered to one side of the non-conductive board.

In another form, the light sensitive metal layer of the circuit board is used to receive light images of the conductive metal zones which are "printed" on the non-conductive body following removal of the metal not chemically reduced by the light pattern. The non-conductive portions exposed by the removal of metal are the resist zones. The resulting disc body with conductive metal and resist zones is then similarly positioned in the electrochemical bath of initial and final selective nickel bonding of the diamond particle zone.

The disc body with the discontinuous diamond pattern can then be utilized in many recognized ways in the abrading art. Several improved forms have found utility particularly in applications of the lapidary art. A metal abrading disc with a discontinuous diamond pattern which is sufficiently thin to be flexible is attached to an intermediate elastomeric backing and an outer rigid backing to provide a desired abrading tool. The circuit board type of abrading disc is substantially rigid and is used alone, or is attached to a rigid body to provide another lapidary tool of particular utility. Lapidary type processing includes the foregoing as well as areas such as the optical where optholmic lenses may be ground in spherical or toric form.

DETAILED DESCRIPTION OF THE INVENTION

Looking at the drawings, there is seen in FIG. 1 an abrading disc body which is formed entirely of metal, particularly steel. This body is sufficiently thin so as to be flexible and is about 0.006 inches thick. One surface of the body is the abrading surface 14, and on this surface are interspersed zones of nickel bonded diamonds 16 separated by resist 18, shown herein as discreet and separate zones.

The nickel bonded diamond zones are formed as a continuous narrow, irregular path meandering between the discreet, circular resist zones 18. Only a portion of the abrading surface has been illustrated as comprising the interspersed nickel bonded diamond particles and resist zones, but it is understood that substantially the entire abrading surface 14 of the disc body 12 would have such interspersed zones. The nickel bonded diamond particle zones 16 do not comprise the entire area of the abrading surface, therefore, realizing economies in diamond particles. The nickel bonded diamond particles generally comprise up to about 50% of the total abrading surface, and a thin abrading body, as described herein, has been made with a 37% diamond pattern and a 63% open resist zone pattern.

Figure 2:
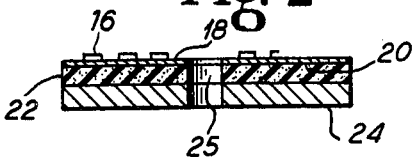
FIG. 2 is a highly diagrammatic sectional view taken along 2—2 of FIG. 1.

The particular abrading disc or tool shown in FIGS. 1 and 2 is in a form which finds particular use in the lapidary art. The backing surface 20 of the disc body 12 is attached to one side of an elastomeric disc or body 22, and the opposite side of the elastomeric disc is attached to a rigid backing member or disc 24. The elastomeric disc, in use, provides some yield to the thin abrading disc 12 which is desired in certain lapidary applications.

Figure 4:
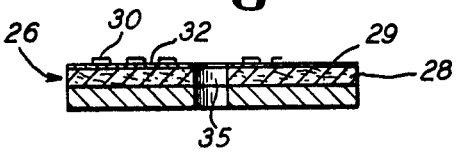
FIG. 4 is a highly diagrammatic sectional view taken along line 4—4 in FIG. 3.
Figure 3:
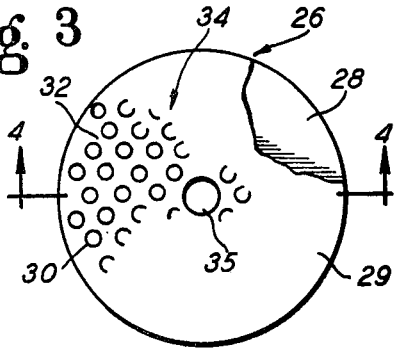
FIG. 3 is a highly diagrammatic side elevational view of an alternative diamond abrading disc showing, in portional view only, discreet nickel bonded diamond particle zones interspersed among resist zones.

FIGS. 3 and 4 illustrate an alternative embodiment wherein the abrading disc 26 is in the form of a circuit board. This includes a disc body 28 of isoelectric material such as composition board. A metal layer 29 is bonded to board 28 in the usual way, such circuit boards being commonly used in the printed circuit board art to form conductors from a light sensitive copper metal layer by projecting an image and etching away areas not chemically reduced by light. It is understood that light sensitive material is not needed in this embodiment, and that a thin layer of metal of, say 0.001 inch – 0.002 inch copper is bonded to a non-conductive board which is substantially rigid, say, 1/16 of an inch, or so. The board contains discreet and separated nickel bonded diamond zones 30 which are spaced by irregular, narrow, continuous paths 32 of resist zones. As in FIGS. 1-2, only a portion of the abrading surface 34 is indicated with the interspersed nickel bonded diamond zones and resist zones, but it is understood that substantially the entire abrading surface would be covered with such interspersed zones. The nickel bonded diamond zones rise above the metal layer 29, and the resist zones 32 are substantially a part of the planar metal surface.

Figure 5:
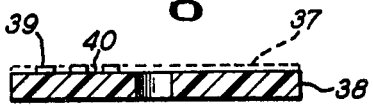
FIG. 5 is a highly diagrammatic sectional view of an alternative embodiment wherein the conductive and free resist zones are obtained by the circuit board technique.
Figure 6:
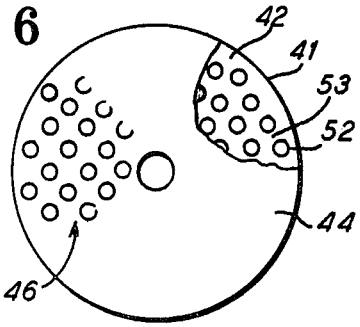
FIG. 6 is a highly diagrammatic side elevational view of a metal disc body contacted by a screen, with portions removed, illustrating a step in the process of making abrading discs with discontinuous diamond patterns.

The nickel bonded diamond zones may also be discreet, circular and separated conductive metal zones which are laid down by the conventional circuit board technique. In particular, a photosensitive metal layer, indicated by broken line 37 in FIG. 5, is laid down on a non-conductive disc body 38, and a selected pattern image is projected on the photosensitive metal layer. The area not reduced by such light sensitivation is removed by etching or the like so that the resulting discreet metal conductive zones 39 represent the reduced and light sensitized areas, whereas the resist zones 40 represent areas of the non-conductive board wherein the previous photosensitive metallic layer 37 was removed by acid etching or other steps. Such resist zones are substantially a part of the planar surface.

FIGS. 3 and 4 show the nickel bonded diamond particle zones, and their underlying metal conductive zones, as being discreet, circular and separated. It is understood, however, that such metal conductive zones may alternatively be the irregular, narrow, continuous paths separating such discreet circular zones, and the circular zones may comprise the resist zones of the abrading surface. Similarly, the configuration of the metal conductive and resist zones in FIGS. 1 and 2 may be reversed.

An abrading tool is made with disc 26 by attaching one side of a rigid backing member or disc 34 to the backing surface 36 of the abrading disc 26. This laminated tool is shown in the view of FIG. 4. Such a circuit board abrading disc 26 and with rigid backing disc 34 is useful in certain applications of the lapidary art. It should be understood, however, that the abrading tools of FIGS. 3 and 4, as well as the abrading tool of FIGS. 1 and 2, may find a wide variety of useful applications in the abrading art.

The foregoing views refer to an abrading tool or abrading disc body in disc form wherein substantially the entire circular surface is the abrading surface. It will be understood that the teachings of the present invention with respect to selective interspersing of diamond particle and resist zones can be applied to abrading surfaces such as annular abrading surfaces on the face of a bowl type abrading tool. Other forms and applications of abrading tools will occur to practitioners in utilizing the teachings of this invention.

The improved method for making abrading discs with discontinuous diamond pattern abrading surfaces is illustrated in the following FIGS. 6–11. In one form, a metal disc body 41 has substantially its entire abrading surface 42 covered with a screen 44 in which a predetermined pattern of openings are present, indicated generally at 46. A resist liquid material is applied by various means, as by a spray mist 48 from nozzle 50. The liquid material may likewise be applied by brushing or by still other equivalent means. In any event, the liquid resist material is spread over the screen 44 so that it passes through the pattern of openings 46 and onto the abrading surface 42 of the disc body 41. The screen 44 is then removed and the liquid resist material is dried to form a pattern of resist zones on the abrading surface of the disc, such zones indicated at 52 in the view of FIG. 5 on the abrading surface. Known resist materials can be used, such as acid resist inks supplied by Nazdar Co. of Chicago, Ill., under the trade designation IL-111 Industrial Lacquer.

Figure 8:
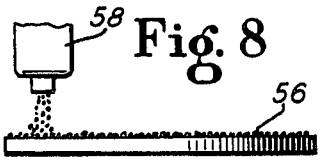
FIG. 8 is a highly diagrammatic and elevational view illustrating the step of nonselectively dispersing diamond particles over the abrading surface of the metal disc body.

The abrading surface 42 of the metal disc 41 is then nonselectively covered with a layer 56 of diamond particles which may have various particle sizes, say, from about 100 grit to about 800 grit. This is indicated in the view of FIG. 8, although this schematic is intended to represent the disc as being positioned within the bath of the tank.

The diamond particle layer 56 is formed by sprinkling or other dispensation from a diamond particle container or supply 58. The diamond particle layer 56 is laid down in a substantially uniform thickness although this is not at all critical. What is required is that a layer is nonselectively laid down over substantially the entire abrading surface 42 of the disc body so that both the metal conductive zones 53 and the resist zones 52 separating such metal conductive zones are covered.

Figure 13:
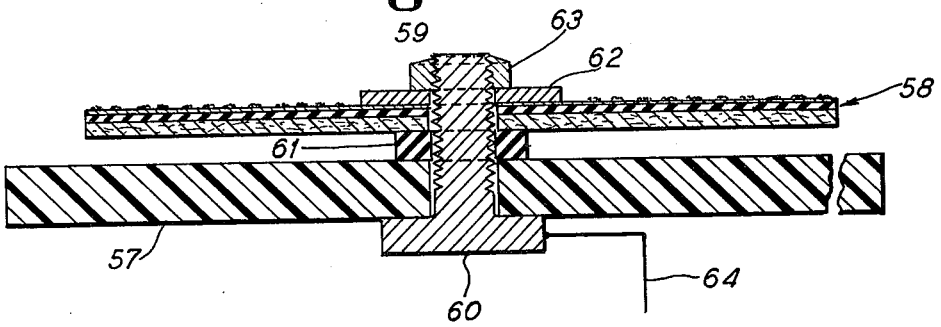
FIG. 13 is a side elevational view taken in section, with portions removed, illustrating mounting of a disc for treatment in the electro-chemical deposition bath.

Disc bodies, each having a layer of diamond particles, are preferably mounted to an elongated support bracket 57 which may be a plexiglass bar. A number of discs may be mounted to the bracket 57 by bolt assemblies, shown best in the view of FIG. 13. A circuit board type disc of the kind illustrated in FIGS. 3 and 4 is indicated at 58, and the central passageway 59 of the abrading disc receives the threaded shank of a bolt 60. The bolt assembly further has an annular spacer 61 threadably engaged to the shank of the bolt and positioned between the plexiglass bar 57 and the underside of the abrading disc 58. The bolt assembly is completed by conductive metal washers 62 and nut 63. A conductor connection 64 is shown joined to the head of the bolt 60.

Figure 10:
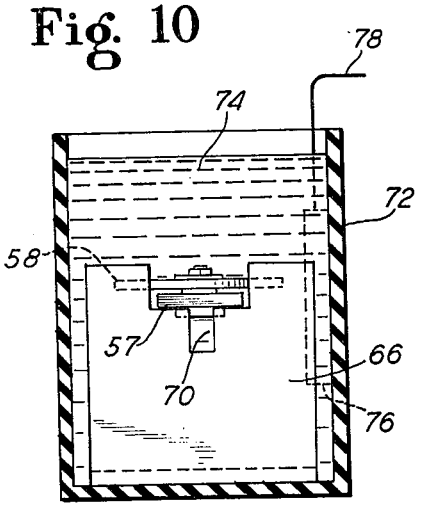
FIG. 10 is a highly diagrammatic sectional view taken along line 10—10 in FIG. 9.
Figure 12:
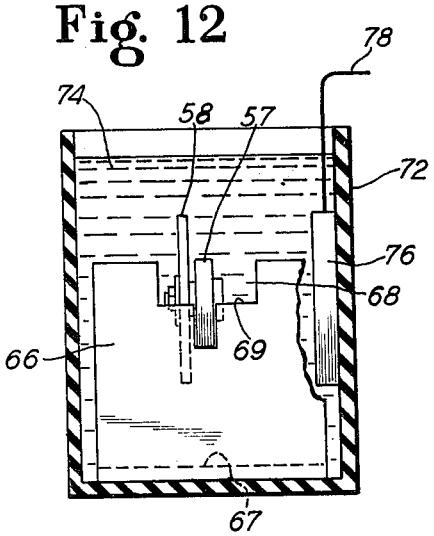
FIG. 12 is a highly diagrammatic sectional view taken along line 12—12 in FIG. 11.

The plexiglass bar with its mounted abrading disc bodies is removably and variously mounted on a channel fixture having upright walls 66 and a connecting bottom wall 67. Each upright wall 66 has a cutout at the top edge which is T-shaped, and is best seen in the views of FIGS. 10 and 12. The horizontal cut-out portion 68 has a width slightly oversized relative to the plexiglass bar 57, and the body of such plexiglass bar rests on shoulders 69 of the horizontal cut-out. A vertical cut-out portion 70 divides the shoulders and communicates with the horizontal cut-out portion 60.

Figure 7:
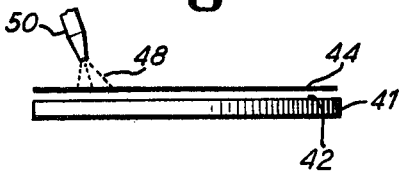
FIG. 7 is a highly diagrammatic and elevational view illustrating the step of applying liquid resist material through the screen to obtain resist zones of the liquid material on the abrading surface of the metal disc.

It should be known that the preparation of the resist zones, as shown in FIG. 7, can be performed before the disc body is mounted to the plexiglass bar, but that the nonselective dispersion of the diamond particles, as shown in FIG. 8, is executed after such operating disc body is mounted to the plexiglass bar, particularly after the discs have been brightened in the bath. The plexiglass bar, with the plurality of mounted disc bodies, is then horizontally positioned on the fixture so that such plexiglass bar rests on the shoulders 69 of the cut-out. The elongated bracket bar, with disc bodies and nonselectively dispersed diamond particles, is transferred by level movement into an electrodeposition tank 72 containing the standard Watts solution or bath 74.

An anode 76 is provided within the tank 72, and such anode is connected by conductor 78 to positive ground. The anode, which is usually nickel, is deposited in the electrodeposition process wherein the mounted disc bodies serve as the cathodes. The connecting conductor 64 from the bolt assemblies are joined to a common conductor 80 to negative voltage.

Current of selected amperage actuates the process of electrodeposition in the usual way, whereby nickel is deposited to initially bond the diamond particles only to the metal conductive zones. In preferred practice, the conductive metal zones on the abrading metal surface are initially brightened with nickel deposition prior to distributing the layer of diamonds, but such practice may be modified as the practitioner desires.

Figure 9:
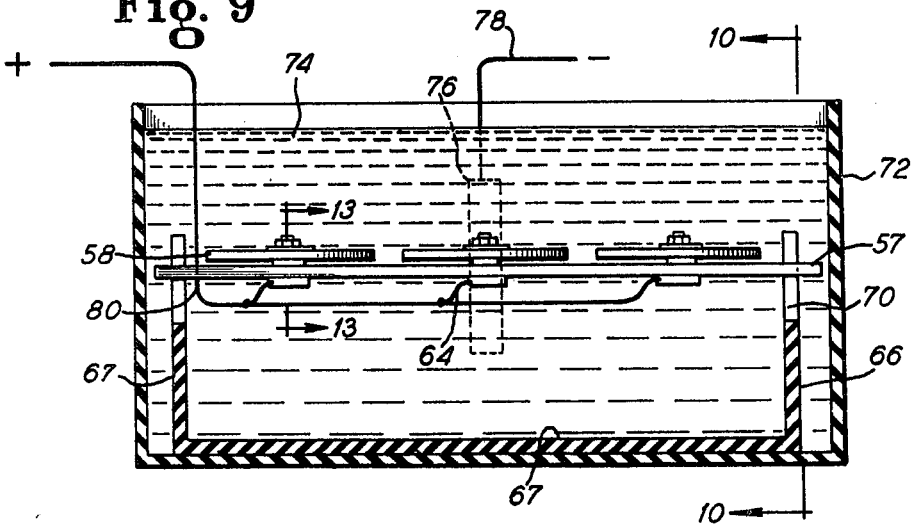
FIG. 9 is a highly diagrammatic side elevational view showing the disc with nonselectively distributed diamond particles deposited in an electrochemical bath for selective bonding of the diamond particles to the conductive metal zone.
Figure 11:
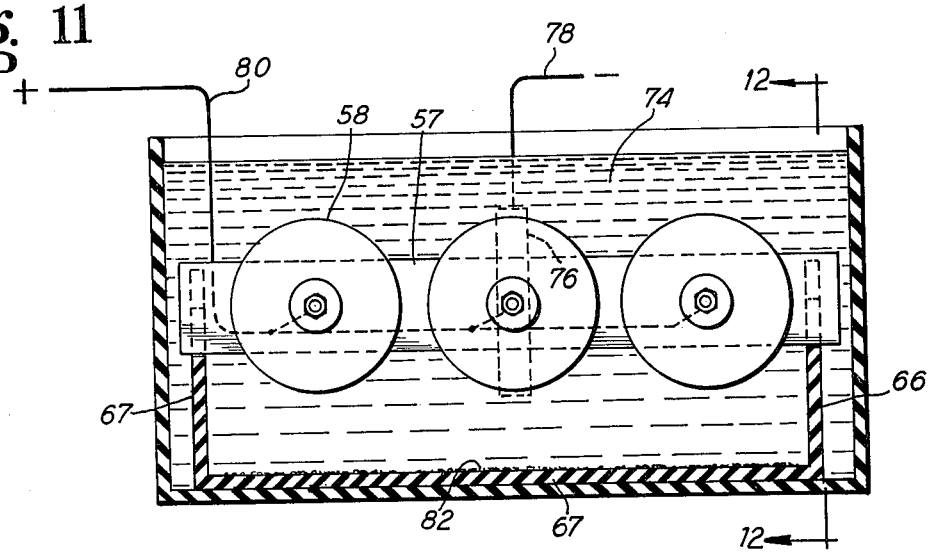
FIG. 11 is a view similar to that of FIG. 9, but illustrating the final nickel bonding of diamond particles after changing the orientation of the discs.

In the view of FIG. 9, the planar surface of the abrading disc bodies and the elongated bracket are substantially parallel to ground surface which is coincidental with the bottom wall 67 of the fixture and the bottom of the tank 72. The maintenance of such a horizontal orientation prevents undesired spillage of the diamond particle layer prior to completion of initial bonding. After such initial bonding, the orientation of the planar surfaces relative to the ground surface are changed, preferably by first tilting and shaking the bar and mounted disc bodies before mounting the plexiglass bar in vertical orientation within the cutouts, as indicated in the view of FIG. 11. This step dislodges the diamond particles resting on the resist zones of the various disc bodies because such diamond particles have not been bonded by electrodeposition of nickel. The dislodged diamond particles fall to the bottom wall 67 of the fixture, as well as to the bottom of tank 72. An accumulated layer of dislodged diamond particles is indicated at 82 in the view of FIG. 11.

The plexiglass bar is seated in the slightly oversized vertical cutout portion 70 in the end wall 66 of the fixture so that the orientation of the disc bodies is now vertical relative to ground surface. In particular, the plane of the abrading surfaces of the respective discs are normal to ground surface and parallel to the long sidewalls of the tanks 72.

The parallel relationship of the plane of the abrading discs, relative to a sidewall of the tank 72, presents the most efficient position relative to the anode 76 mounted on a sidewall of the tank. The initially bonded diamond particles to the metal zone remain in place until final or successive nickel bonding is executed.

The steps illustrated in foregoing FIGS. 7–13 have been described in relation to a metal disc body in which the resist zones have been laid down as a film of liquid material on a planar metal surface. It will be appreciated that this film of liquid material does not substantially alter the planar surface, as compared to the nickel bonded diamond particle zones which rise above the planar surface of the abrading disc. It should also be understood that the steps illustrated in foregoing FIGS. 7-13 are employed with a printed circuit board type of disc body such as shown in the view of FIG. 5. Such a circuit board will have interspersed conductive metal zones and resist zones, and the board is initially brightened in the tank. The subsequent sprinkling or dispersing of the diamond particles over the abrading surface will be nonselective as indicated in the view of FIG. 8, such sprinkling preferably performed while the discs are in the tank. The conductive metal zones on the abrading surface of said circuit board disc will then be selectively deposited with nickel to bond the diamond particles resting thereon. The diamond particles on the resist zones will not be bonded, and such diamond particles will be dislodged by changing the orientation of the bar and mounted discs as indicated in the view of FIG. 11. Finally, the nickel bonded zones on the circuit board will be bonded by changing the position of the circuit board disc body to vertical orientation as indicated in the view of FIG. 11.

The disc form has been disclosed as a particularly useful form of the abrading tool, but it should be understood that other configurations can be useful within the teachings of the invention. For example, a polygonal abrading metal body may be prepared with a discontinuous abrading surface, and such metal body may be mounted as a layer to one face of a plastic block. In a particularly preferred form, the pattern is formed on the abrading surface of a rectangular circuit board which may then be mounted to a base for handling in use. A handle may be on an opposite face. The resulting abrading tool can serve as a sanding block of virtually inexhaustable life. Other forms of abrading tools will occur to practitioners.

The claims of the invention are now presented and the terms of such claims may be further understood by reference to the language of the preceding specifications and the views of the drawings.

What is claimed is:

1. A method for making an abrading tool having a discontinuous diamond pattern on a planar abrading surface which has interspersed conductive metal zones and resist zones, said surface being on an abrading body, which includes the steps of placing the abrading body in an electrochemical bath and initially depositing a metal layer on the planar abrading surface, distributing diamond particles nonselectively over the abrading surface of the abrading body, electrodepositing nickel to initially and selectively bond the diamond particles to the metal zones without bonding to the resist zones, changing the orientation of the planar abrading surface from parallel relationship with the ground surface to dislodge the diamond particles from the resist zones and off the abrading body, and successively electrodepositing nickel to finally bond the diamond particles which were initially bonded at said metal zones without bonding any nickel to said resist zones.

2. A method for making an abrading tool which includes the features of claim 1 wherein at least the planar surface of said abrading body is metal, and which further includes the steps of contacting the planar abrading surface of the metal with a screen having a predetermined pattern of openings, and applying a liquid resist material over said screen so that the resist material passes through the pattern of openings onto the planar abrading surface, the resist material passing through said openings forming the resist zones on the planar abrading surface.

3. A method for making a diamond abrading tool which includes the features of claim 2 wherein said abrading body is a substantially rigid composition board having a planar metal layer bonded to one side to provide a metal planar abrading surface.

4. A method for making a diamond abrading tool which includes the features of claim 1 wherein said abrading body is a substantially rigid composition board having a planar metal layer bonded to one side to provide a light sensitive metal planar abrading surface, and which further includes projecting a light pattern of the desired conductive metal zones on said metal layer, and then removing the metal outside said light pattern to uncover the underlying composition board on said free resist zones.

5. A method for making a diamond abrading tool which includes the steps of claim 1 wherein said abrading body with the initially nickel bonded diamond particles is repositioned in the electrochemical bath so that the planar surface is in vertical relationship to the ground surface, whereby said nickel is successively electrodeposited onto the abrading surface while the disc is retained in said vertical orientation.

* * * * *